US007857295B2

(12) United States Patent
Zhang et al.

(10) Patent No.: US 7,857,295 B2
(45) Date of Patent: Dec. 28, 2010

(54) CLAMPING MECHANISM

(75) Inventors: Bing-Jun Zhang, Shenzhen (CN); Lian-Zhong Gong, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 86 days.

(21) Appl. No.: 11/967,014

(22) Filed: Dec. 29, 2007

(65) Prior Publication Data

US 2009/0106956 A1 Apr. 30, 2009

(30) Foreign Application Priority Data

Oct. 25, 2007 (CN) ..... 2007 1 0202252

(51) Int. Cl.
*B25B 5/16* (2006.01)

(52) U.S. Cl. ..... 269/152; 269/6; 269/249

(58) Field of Classification Search ..... 269/152, 269/3, 6, 249, 252
See application file for complete search history.

(56) References Cited

U.S. PATENT DOCUMENTS 2,803,872 A * 8/1957 Massa ..... 269/37
6,412,158 B1 * 7/2002 Moore ..... 29/249
6,568,667 B1 * 5/2003 Hall ..... 269/6
6,585,243 B1 * 7/2003 Li ..... 269/6
6,648,315 B1 * 11/2003 Lee ..... 269/6
7,017,894 B1 * 3/2006 Lin ..... 269/6
7,614,617 B2 * 11/2009 Marusiak ..... 269/6
2005/0077667 A1 * 4/2005 Chang ..... 269/6
2006/0091596 A1 * 5/2006 Marusiak ..... 269/6
2008/0157450 A1 * 7/2008 Marusiak ..... 269/6
2009/0106956 A1 * 4/2009 Zhang et al. ..... 24/530

FOREIGN PATENT DOCUMENTS

CN 2737502 Y 11/2005

* cited by examiner

*Primary Examiner*—Lee D Wilson
(74) *Attorney, Agent, or Firm*—Frank R. Niranjan

(57) ABSTRACT

A clamping mechanism includes a fixing table forming a bracket, a first clamping apparatus, and a second clamping apparatus. The first clamping apparatus includes a sliding member slidably installed on an upper portion of the bracket, and a movable member coupled to the sliding member. The sliding member forms a protrusion, and a first clamping device is installed on the movable member for cooperating with the protrusion of the sliding member to sandwich an upper portion of a workpiece therebetween. The second clamping apparatus includes a sliding block slidably installed on a lower portion of the bracket, and a positioning post slidably installed on the fixing table. The sliding block forms a protrusion, and a second clamping device is installed on the positioning post for cooperating with the protrusion of the sliding block to sandwich a lower portion of the workpiece therebetween.

17 Claims, 6 Drawing Sheets

CLAMPING MECHANISM

BACKGROUND

1. Field of the Invention

The present invention relates to clamping mechanisms, and more particularly to a clamping mechanism for clamping a flat workpiece during testing.

2. Description of Related Art

Typically, a workpiece is vertically placed to lean against a tool and held by hand during testing. However, it is troublesome to hold the workpiece by hand. Furthermore, if the workpiece is made of the thin material, the workpiece may be bent as a result of the handling.

What is needed, therefore, is a clamping mechanism which is able to quickly and safely clamp a workpiece.

SUMMARY

An exemplary clamping mechanism includes a fixing table forming a bracket, a first clamping apparatus, and a second clamping apparatus. The first clamping apparatus includes a sliding member slidably installed on an upper portion of the bracket, and a movable member coupled to the sliding member. The sliding member forms a protrusion, and a first clamping device is installed on the movable member for cooperating with the protrusion of the sliding member to sandwich an upper portion of a workpiece therebetween. The second clamping apparatus includes a sliding block slidably installed on a lower portion of the bracket, and a positioning post slidably installed on the fixing table. The sliding block forms a protrusion, and a second clamping device is installed on the positioning post for cooperating with the protrusion of the sliding block to sandwich a lower portion of the workpiece therebetween.

Other advantages and novel features will become more apparent from the following detailed description of embodiments when taken in conjunction with the accompanying drawings, in which:

DETAILED DESCRIPTION

Figure 1:
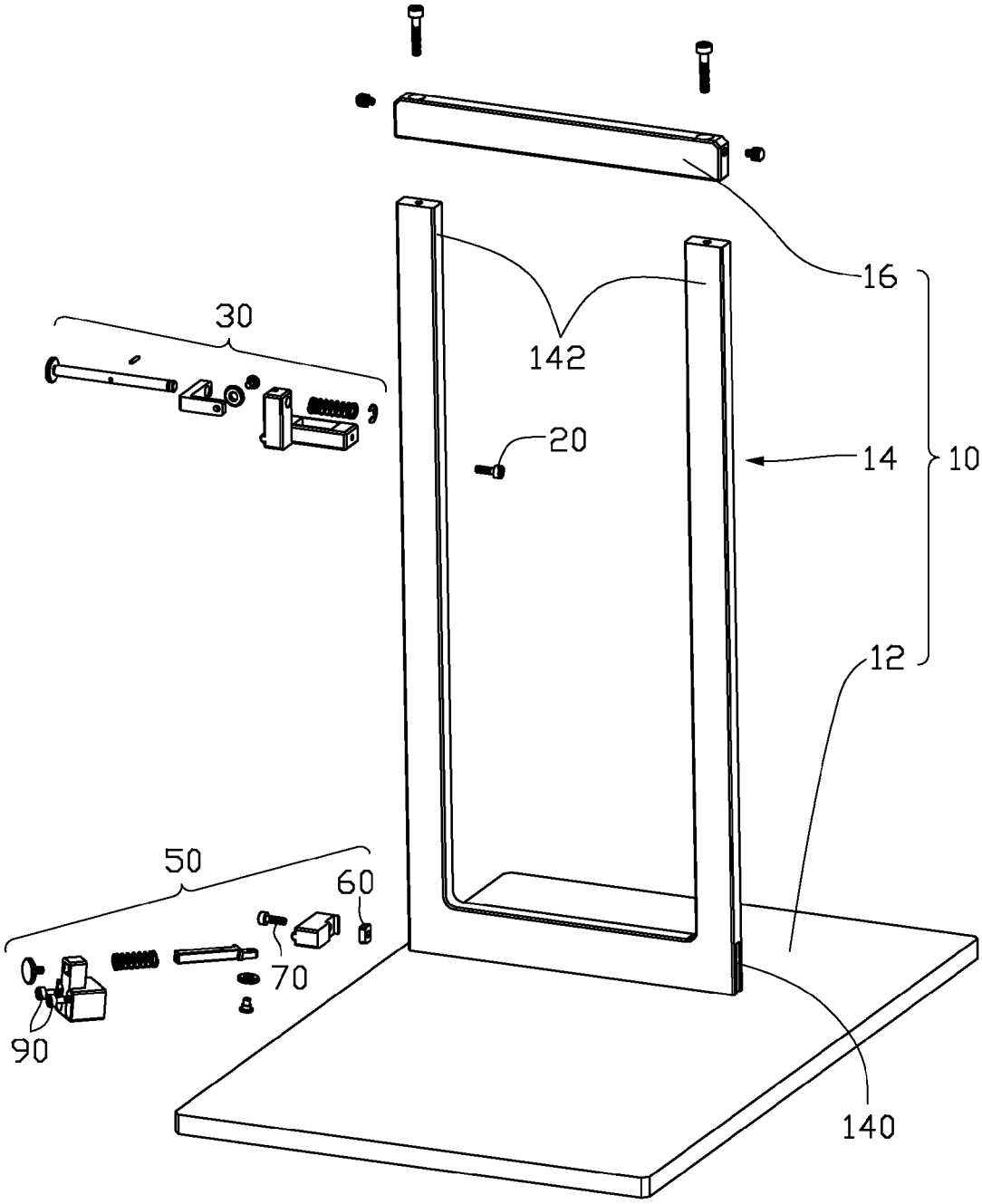
FIG. 1 is an exploded, isometric view of a clamping mechanism in accordance with an embodiment of the present invention, the clamping mechanism includes a first clamping apparatus, and a second clamping apparatus.

Referring to FIG. 1, a clamping mechanism for a flat workpiece is provided in accordance with an embodiment of the present invention. The clamping mechanism includes a fixing table 10, a first clamping apparatus 30, and a second clamping apparatus 50.

The fixing table 10 includes a base 12, a generally U-shaped bracket 14, and a beam 16 connected to a top portion of the bracket 14. The bracket 14 includes two opposite vertical supporting posts 142, and each supporting post 142 defines a recess 140 in a lower portion of a side thereof away from the other supporting post 142.

Figure 2:
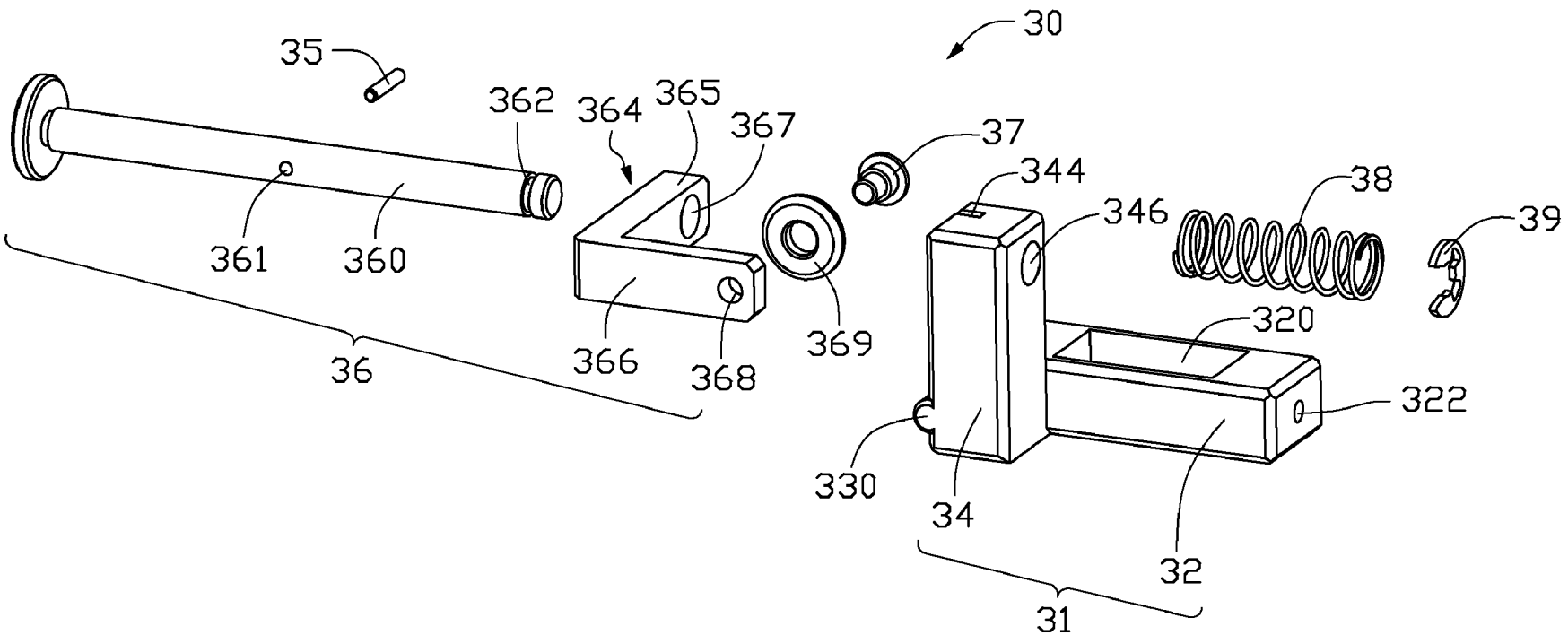
FIG. 2 is an enlarged isometric view of the first clamping apparatus of FIG. 1
Figure 3:
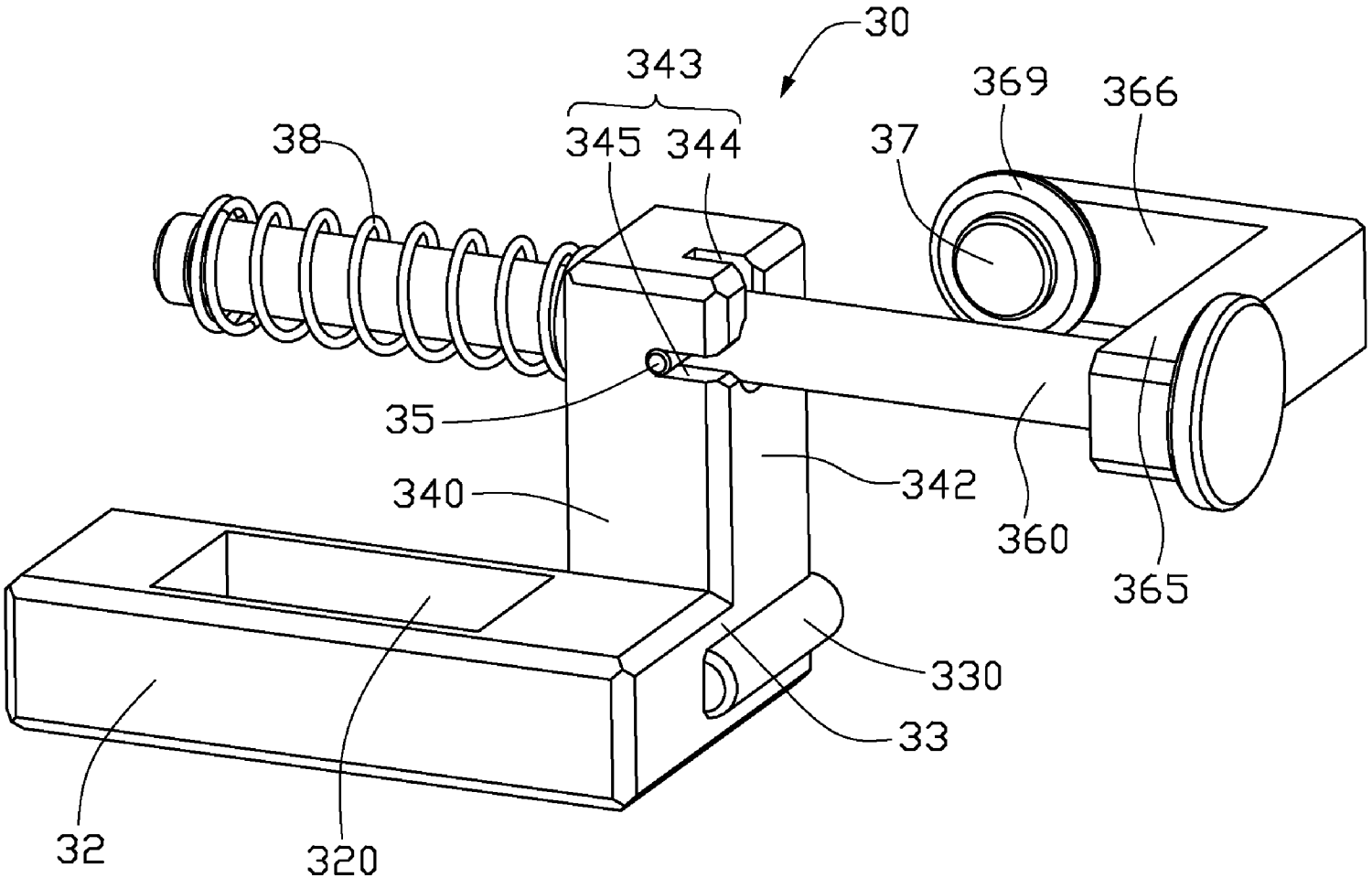
FIG. 3 is an assembled view of FIG. 2, but viewed from another aspect.

Referring to FIGS. 2 and 3, the first clamping apparatus 30 includes a sliding member 31, an annular first clamping device 369, and a movable member 36. The sliding member 31 includes a horizontal sliding portion 32 defining an opening 320 through top and bottom surfaces thereof, and a vertical latching portion 34 extending upward from a side of the sliding portion 32 adjoining a first end thereof. A fixing hole 322 is defined in a second end opposite to the first end of the sliding portion 32 in communication with the opening 320. The latching portion 34 includes an end surface 342 coplanar with the first end of the sliding portion 32. A semi-columnar protrusion 330 is formed on the first end of the sliding portion 32 and horizontally extends across the end surface 342 of the latching portion 34. A reversed L-shaped slot 343 is defined in an upper section of the end surface 342 of the latching portion 34. The slot 343 includes a vertical slot 344 through the top surface of the latching portion 34, and a horizontal slot 345 through a side 340 of the latching portion 34 toward the sliding portion 32. A through hole 346 perpendicular to the end surface 342 is defined in the latching portion 34 at the joint of the vertical slot 344 and the horizontal slot 345. The movable member 36 includes a rotating device 364, and a pole 360. The rotating device 364 includes a rotating portion 365 defining a pivoting hole 367 therein, adjacent to one end thereof, and an arm 366 perpendicularly extending from the opposite end of the rotating portion 365. A fixing hole 368 is defined in the arm 366 adjacent to a free end thereof. The pole 360 forms an operating portion 363 at one end thereof, and defines a groove 362 in a circumference of the pole 360 adjacent to the opposite end thereof. A threaded hole 361 is defined transversely through a middle section of the pole 360.

Figure 5:
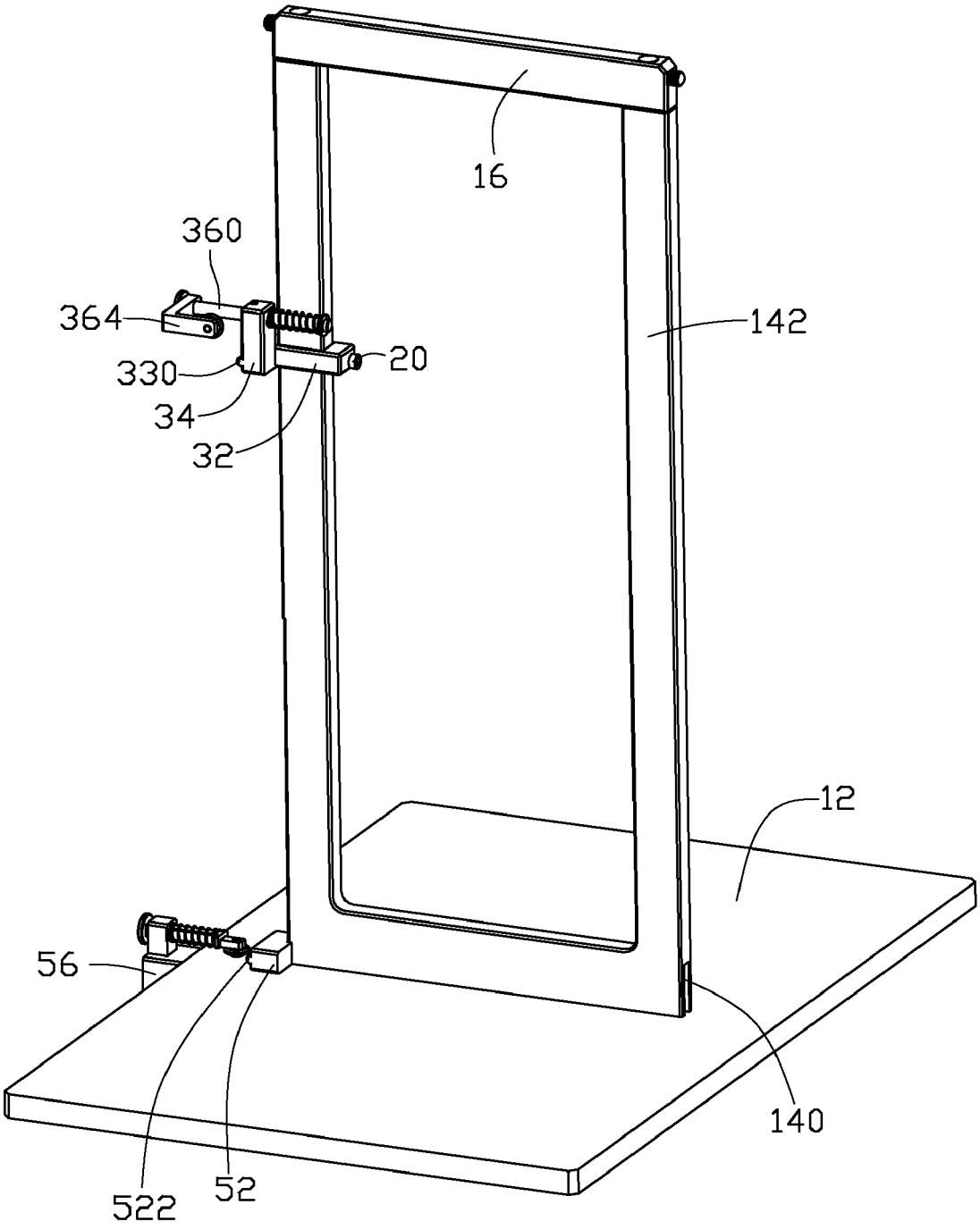
FIG. 5 is an assembled view of FIG. 1.

Referring further to FIGS. 1 and 5, in assembly of the first clamping apparatus 30, a fastener 37 is extended through the first clamping device 369 and then engages in the fixing hole 368 of the arm 366 of the rotating device 364, thereby the first clamping device 369 is rotatably coupled to the rotating device 364. The pole 360 is extended through the pivoting hole 367 of the rotating device 364, and the rotating device 364 is fixed to the operating portion 363 of the pole 360. A pin 35 threaded at one end, is provided, the threaded end of the pin 35 is screwed into the threaded hole 361 of the pole 360, leaving a portion of the pin 35 extended out of the hole 361, and the pin 35 is positioned parallel to the rotating portion 365 of the rotating device 364. Thereafter, the pole 360 is further extended through the through hole 346 of the latching portion 34 of the sliding member 31, and the pin 35 engages in the horizontal slot 345 of the latching portion 34, thereby the pole 360 and the rotating device 364 are connected to the sliding member 31, and the rotating portion 365 is in a horizontal position. An elastic member 38, such as a coil spring is placed around the pole 360, and a stop plate 39 is engaged in the groove 362 of the pole 360. Two ends of the elastic member 38 are fixed to the stop plate 39 and the latching portion 34 of the sliding member 31 respectively. The sliding member 31 is placed around the one of the supporting posts 142 of the fixing table 10, to allow the supporting post 142 to extend through the opening 320 of the sliding portion 32. A screw 20 is screwed into the fixing hole 322 of the sliding portion 32 and engages with an upper portion of the supporting post 142. Thereby, the first clamping apparatus 30 is fixed to the upper portion of the supporting post 142. The beam 16 is fixed to the top portions of the supporting posts 142 with two fasteners (not labeled).

Figure 4:
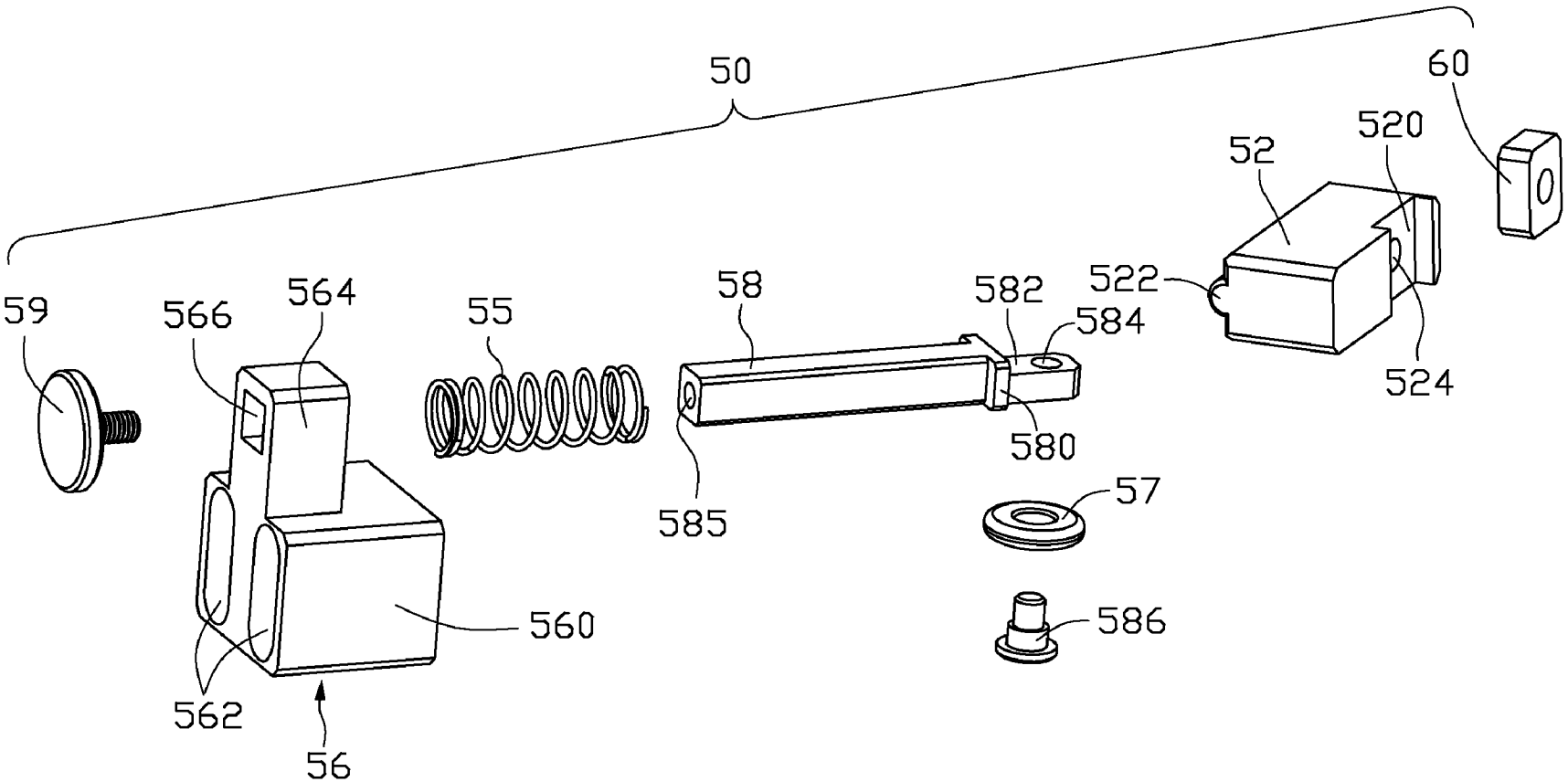
FIG. 4 is an enlarged, isometric view of the second clamping apparatus of FIG. 1.

Referring to FIG. 4, the second clamping apparatus 50 includes a sliding block 52, a positioning block 56, a positioning post 58, and an annular second clamping device 57. The sliding block 52 defines a concave portion 520 in one side thereof, and forms a semi-columnar protrusion 522 on the opposite side thereof. A through slot 524 is defined in the concave portion 520. The positioning block 56 includes a main body 560, and a supporting portion 564 extending from a top section of the main body 560. Two elongated holes 562 is defined in the main body 560, and a fixing hole 566 parallel with the elongated holes 562 is defined in the supporting portion 564. The positioning post 58 forms a stop plate 580 at one end thereof, and defines a threaded hole 585 at the opposite end thereof. A tab 582 perpendicularly extends from the stop plate 580, and a pivoting hole 584 is defined in the tab 582.

Referring also to FIGS. 1 and 5, in assembly of the second clamping apparatus 50, a fastener 586 is extended through the second clamping device 57 and then engages in the pivoting hole 584 of the positioning post 58, thereby the second clamping device 57 is rotatably coupled to the positioning post 58. An elastic member 55, such as a coil spring is placed around the positioning post 58. The positioning post 58 is extended through the fixing hole 566 of the positioning block 56, and then a fastener 59 is screwed into the threaded hole 585 of the positioning post 58. Thereby, the positioning post 58 is slidably connected to the positioning block 56, and two ends of the elastic member 55 are fixed to the stop plate 580 of the positioning post 58 and the supporting portion 564 of the positioning block 56 respectively. Two screws 90 are extended through the elongated holes 562 of the positioning block 56 respectively and engage with a portion of the base 12 adjacent to the supporting post 142 connecting with the first clamping apparatus 30. Thereby, the positioning block 56 and the positioning post 58 are fixed to the fixing table 10. A quadrate nut 60 is slidably received in the recess 140 of the supporting post 142. The concave portion 520 of the sliding block 52 engages with the supporting post 142, a screw 70 is extended through the through slot 524 of the sliding block 52 and then engages in the nut 60. Thereby, the sliding block 52 is slidably connected to the supporting post 142.

Figure 6:
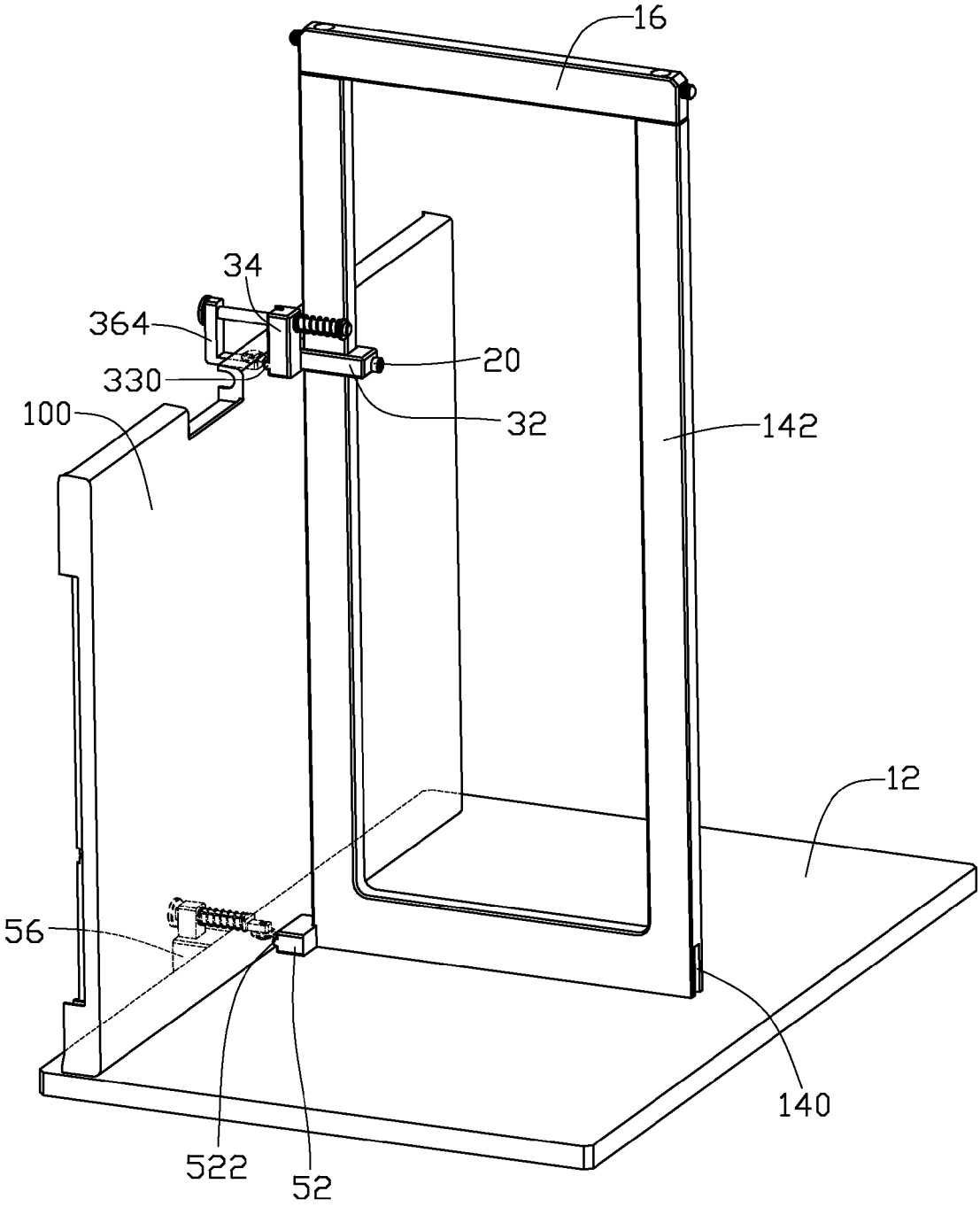
FIG. 6 is similar to FIG. 5, showing a workpiece is clamped by the clamping mechanism.

Referring to FIG. 6, in use, the sliding portion 32 of the first clamping apparatus 30 and the sliding block 52 of the second clamping apparatus 50 are adjusted to fit the length of a workpiece 100. The positioning block 56 is adjusted to be fixed at different heights by the screws 90, for allowing the second clamping device 57 installed on the positioning post 58 to align with the protrusion 522 of the sliding block 52. The fastener 59 connected to the positioning post 58 is pulled away from the supporting post 142. The workpiece 100 is vertically placed on the base 12 of the fixing table 10, and one side of the workpiece 100 contacts the protrusions 522, 330 of the sliding block 52 and the sliding member 31. The fastener 59 and the positioning post 58 are released, the elastic member 55 is restored to push the positioning post 58 and the second clamping device 57 to move toward the workpiece 100. A flange of the second clamping device 57 abuts against the workpiece 100, and a lower portion of the workpiece 100 is sandwiched between the second clamping device 57 and the protrusion 522 of the sliding block 52. The pole 360 is pulled away from the supporting post 142, and the pin 35 disengages from the horizontal slot 345 of the sliding member 31. The pole 360 is rotated to allow the rotating device 364 to orient in a vertical position under the pole 360, and a flange of the first clamping device 369 to align with the protrusion 330 of the sliding member 31. The pole 360 is released, the elastic member 38 is restored to push the pole 360 to move toward the workpiece 100. The pin 35 engages in the vertical slot 344, and the flange of the first clamping device 369 abuts against the workpiece 100. Thereby, an upper portion of the workpiece 100 is sandwiched between the first clamping device 369 and the protrusion 330 of the sliding member 31.

When there is a need to orient the workpiece 100 to a different position, the workpiece 100 is pulled or pushed on the fixing table 10, and the first and second clamping devices 369, 57 are rotated via force of friction between them and the workpiece 100. Thereby, the workpiece 100 is positioned in a new position.

In other embodiments, the first and second clamping devices 369, 57 may be replaced by balls or wheels.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A clamping mechanism for a workpiece, the clamping mechanism comprising:

a fixing table, a bracket installed on the fixing table;

a first clamping apparatus comprising a sliding member slidably installed on an upper portion of the bracket, a movable member coupled to the sliding member, and a first elastic member connected between the movable member and the sliding member for restoring the movable member, the sliding member forming a protrusion thereon, and a first clamping device installed on the movable member for cooperating with the protrusion of the sliding member to sandwich an upper portion of the workpiece therebetween; and a second clamping apparatus comprising a sliding block slidably installed on a lower portion of the bracket, a positioning post slidably installed on the fixing table, and a second elastic member for restoring the positioning post, the sliding block forming a protrusion thereon, and a second clamping device installed on the positioning post for cooperating with the protrusion of the sliding block to sandwich a lower portion of the workpiece therebetween.

2. The clamping mechanism as claimed in claim 1, wherein the sliding member comprises a sliding portion, an opening is defined in the sliding portion, the bracket comprises a supporting post extending through the opening of the sliding portion.

3. The clamping mechanism as claimed in claim 2, wherein the sliding member further comprises a latching portion extending upward from a side of the sliding portion, the latching portion comprises an end surface coplanar with an end of the sliding portion, the protrusion is formed on the end of the sliding portion and horizontally extends toward the end surface of the latching portion.

4. The clamping mechanism as claimed in claim 3, wherein the movable member comprises a pole movably connected to the latching portion, and a rotating device fixed to one end of the pole, the rotating device comprises a rotating portion perpendicular to the pole, and an arm perpendicularly extending from a free end of the rotating portion toward the bracket, the first clamping device is rotatably installed on a free end of the arm, a flange of the first clamping device aligns with the protrusion of the sliding member.

5. The clamping mechanism as claimed in claim 4, wherein the latching portion defines a through hole and a first slot communicating with the through hole in an upper section thereof, a pin is connected to a middle section of the pole, the pole extends through the through hole of the latching portion, and the pin engages in the slot for fixing the pole to the latching portion and locating the rotating device in a first position such that the flange of the first clamping device aligns with the protrusion of the sliding member.

6. The clamping mechanism as claimed in claim 5, wherein the latching portion further defines a second slot communicating with the through hole and perpendicular to the first slot, the pin is capable of engaging in the second slot of the latching portion to locate the rotating device in a second position perpendicular to the first position.

7. The clamping mechanism as claimed in claim 6, wherein the second clamping apparatus further comprises a positioning block defining a fixing hole therein, one end of the positioning post extends through the fixing hole and engages with a fastener, the opposite end of the positioning post forms a tab, the second clamping device is rotatably installed on the tab and aligns with the first clamping device in a vertical line when the rotating device of the first clamping apparatus in the first position.

8. The clamping mechanism as claimed in claim 7, wherein a stop plate is formed on the positioning pole, the second elastic member is placed around the positioning pole, and two ends of the second elastic member are fixed to the stop plate and the positioning block, respectively.

9. The clamping mechanism as claimed in claim 8, wherein the first and second clamping devices are annular shaped or ball shaped.

10. The clamping mechanism as claimed in claim 4, wherein the pole defines a groove in a circumference adjacent the opposite end of the pole, a stop plate engages in the groove of the pole, the first elastic member is placed around the pole, and two ends of the first elastic member are fixed to the stop plate and the latching portion of the sliding member, respectively.

11. The clamping mechanism as claimed in claim 1, wherein the movable member comprises a pole movably connected to the sliding member, and a rotating device fixed to one end of the pole, the rotating device comprises a rotating portion perpendicular to the pole, and an arm perpendicularly extending from a free end of the rotating portion toward the bracket, the first clamping device is rotatably installed on a free end of the arm, a flange of the first clamping device aligns with the protrusion of the sliding member.

12. The clamping mechanism as claimed in claim 11, wherein the sliding member defines a through hole and a first slot communicating with the through hole in an upper section thereof, a pin is connected to a middle section of the pole, the pole extends through the through hole of the sliding member, and the pin engages in the slot for fixing the pole to the sliding member and locating the rotating device in a first position such that the flange of the first clamping device aligns with the protrusion of the sliding member.

13. The clamping mechanism as claimed in claim 12, wherein the sliding member further defines a second slot communicating with the through hole and perpendicular to the first slot, the pin is capable of engaging in the second slot of the sliding member to locate the rotating device in a second position perpendicular to the first position.

14. The clamping mechanism as claimed in claim 1, wherein the pole defines a groove in a circumference thereof, a stop plate engages in the groove of the pole, the first elastic member is placed around the pole, and two ends of the first elastic member are fixed to the stop plate and the sliding member respectively.

15. The clamping mechanism as claimed in claim 1, wherein the second clamping apparatus further comprises a positioning block defining a fixing hole therein, one end of the positioning post extends through the fixing hole and engages with a fastener, the opposite end of the positioning post forms a tab, the second clamping device is rotatably installed on the tab.

16. The clamping mechanism as claimed in claim 15, wherein a stop plate is formed on the positioning pole, the second elastic member is placed around the positioning pole, and two ends of the second elastic member are fixed to the stop plate and the positioning block respectively.

17. The clamping mechanism as claimed in claim 1, wherein the first and second clamping devices are annular shaped or ball shaped.

* * * * *